United States Patent [19]

Bogaert

[11] 3,943,866

[45] Mar. 16, 1976

[54] ROTARY HOOK FOR SEWING MACHINE

[75] Inventor: Pierre Joseph Bogaert, Sint-Niklaas, Belgium

[73] Assignee: Manta, Waasmunster, Belgium

[22] Filed: Oct. 24, 1973

[21] Appl. No.: 409,348

[30] Foreign Application Priority Data

Oct. 24, 1972 Belgium ..... 790478
Mar. 29, 1973 Belgium ..... 797518

[52] U.S. Cl. ..... 112/228
[51] Int. Cl.[2] ..... D05B 57/14
[58] Field of Search ..... 112/181, 182, 184, 189, 112/190, 228, 229, 231

[56] References Cited

UNITED STATES PATENTS

| | | | |
|---|---|---|---|
| 2,557,844 | 6/1951 | Schmitt | 112/184 |
| 2,583,538 | 1/1952 | Backlin | 112/231 |
| 2,763,227 | 9/1956 | Howard | 112/231 |
| 2,817,307 | 12/1957 | Kuhar | 112/231 |
| 3,120,204 | 2/1964 | Ketterer | 112/228 |
| 3,215,105 | 11/1965 | Kuhar | 112/228 |
| 3,343,510 | 9/1967 | Attwood et al. | 112/228 |
| 3,437,284 | 4/1969 | Philips | 112/229 X |
| 3,709,174 | 1/1973 | Garry | 112/231 |

FOREIGN PATENTS OR APPLICATIONS

| | | | |
|---|---|---|---|
| 1,161,280 | 8/1958 | France | 112/229 |

*Primary Examiner*—Alfred R. Guest
*Attorney, Agent, or Firm*—Sughrue, Rothwell, Mion, Zinn & Macpeak

[57] ABSTRACT

The rotary hook of a sewing machine is provided with a beak portion which extends substantially tangentially outwardly away from the circumferential wall of the rotary hook to capture the needle thread loop at new point radially outwardly of the rotary hook thereby allowing for a shorter needle stroke so that the tip of the needle does not penetrate into the bobbin supporting basket.

7 Claims, 5 Drawing Figures

ROTARY HOOK FOR SEWING MACHINE

This invention relates to a rotary hook for sewing machine having a basket and an outer hook rotating about a horizontal axis around said basket, said outer hook having a bottom and a circumferential wall provided with a beak, the outer hook being moreover provided with a body-guard attached to the circumferential wall and about a portion thereof in the beak area.

In the known rotary hooks of this kind, the beak extends as an extension of the outer hook circumferential wall, concentrically about the hook rotating axis.

By the formation of a stitch, the needle through which is threaded the upper thread, reaches the lowermost position thereof then goes back up somewhat so that the upper thread which does not go up therewith, forms a loop relative to the needle eye. Said loop is then taken along by the rotary hook beak over the basket. Inside the basket lies the lower thread, which is generally wound on a bobbin. In-between the needle goes back up and the loop pulled by the hook is then made taut and forms together with the lower thread, a stich.

In the known hooks, the upper thread loop should thus be formed by the location of a break in the outer hook circumferential wall as the beak is located by said break in the extension of the remainder of said circumferential wall. As the loop is formed level with the needle eye, the needle point should lie in the lowermost position thereof, inside the basket, by going through an opening in the basket circumferential wall. As the needle in the lowermost position thereof enters with the point thereof the basket, the size of the bobbin with the lower thread is limited. Indeed, said bobbin may only extend between the basket bottom and the needle in the lowermost position thereof. This limited size required of the bobbin even if it does not comprise a serious drawback in the rotary hooks which have a bobbin case, becomes a substantial limitation of the lower thread supply in the case of sewing machines in which the rotary hook is not provided with a bobbin case, the bobbin being arranged directly inside the hook basket.

The fact that the needle point in the lowermost position thereof lies inside the basket results from the needle travel and is dependent on the size and the shape of the rotary hook. However the lower the needle lies in the lowermost position the lower it will also lie in the uppermost position thereof and the lower the needle lies in the uppermost position the higher is the danger of breaking said needle. It is when the needle lies in the uppermost position thereof or adjacent said position that the material to be stitched is fed, thus taking in the upper thread along the feeding direction and the lower the needle lies at that moment, the sharper becomes the angle formed by the upper thread which runs between the needle and the material and the higher is then the danger that the needle will be bent and by the lowering thereof then strikes some machine part and breaks. Moreover the lower the needle lies in the uppermost position, the less thick can be the material to be stitched as during the material feeding, said needle should remain outside the material.

The invention has for an object to obviate the above drawbacks and to provide a rotary hook whereby the needle point does no more have to enter the basket inner volume in the lowermost needle position. The hook according to the invention thus allows the selection of the uppermost needle point end position at a level higher than the one of known needles for one and the same sewing machine. For this purpose according to the invention, the outer hook beak end lies further away from the hook rotating axis than the circumferential wall of said outer hook. With the hook according to the invention, as the outer hook beak does project outwards, it takes the loop along when said loop lies higher than what is required with the known rotary hooks.

The invention has also for an object to provide the hook with means for braking the lower thread which are of particular interest when the lower thread supply is mounted directly on the basket without a bobbin case.

For this purpose the rotary hook according to the invention comprises a brake for the lower thread, mounted on the basket circumferential wall.

In a preferred embodiment of the invention, the brake is comprised of a spring that bears partly at least against the outer side of an inwardly-recessed portion of the basket circumferential wall, said spring being provided with an opening for the lower thread that opens on the basket inner side in such a way that said lower thread can be pulled through said opening between the spring outer side and the inner side of said portion of the basket circumferential wall.

Other details and features of the invention will stand out from the description given below by way of non limitative example and with reference to the accompanying drawings, in which.

In the various figures, the same reference numerals pertain to similar elements.

Figure 1:
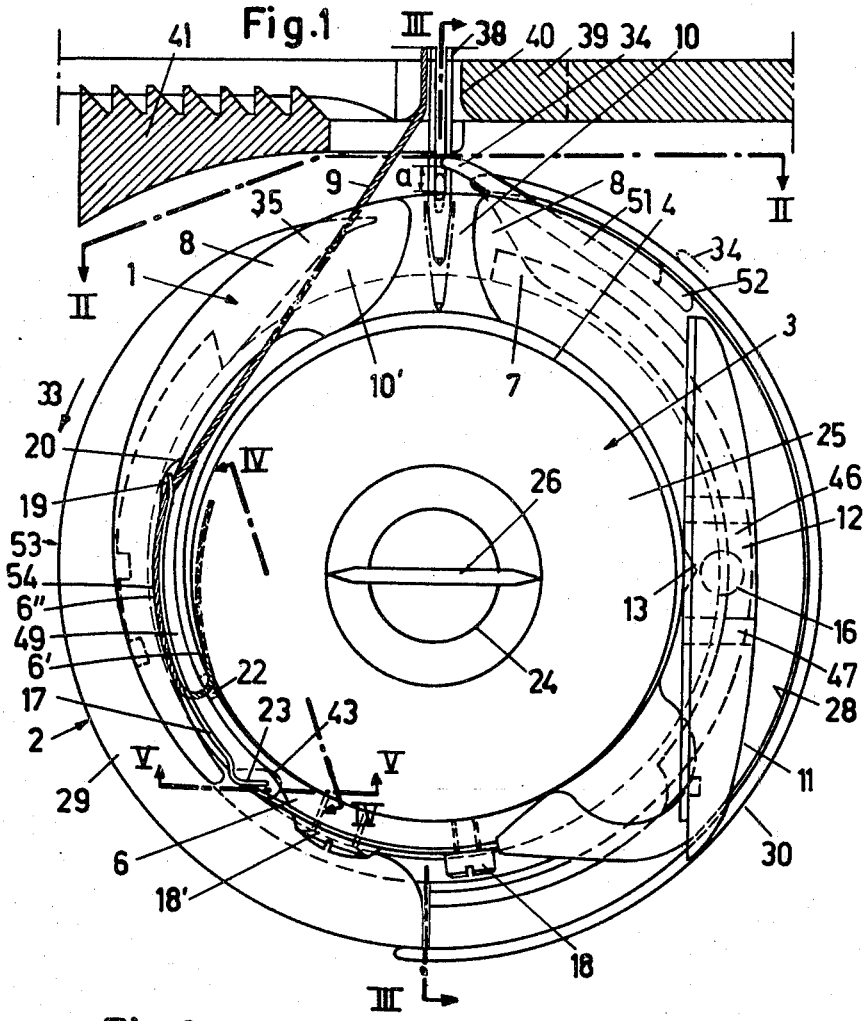
FIG. 1 is a front elevation view of a rotary hook according to the invention, as mounted in a sewing machine shown but partly, the rotary hook cover being shown open.

The rotary hook shown in the figures which is shown generally in 53, is essentially comprised of three parts, namely a basket 1, an outer hook 2 rotating about a horizontal axis around the basket and a bobbin 3 located inside the basket. The basket 1 comprises a circular bottom 4 which lies at right angle to the rotating axis of hook 2 and which is provided with openings 5. The bottom 4 bears a substantially cylindrical wall 6 which is provided on the outer side thereof with a circumferential rib 7 in parallel relationship with the bottom 4 and which is broken in 45. The bottom 4 does not have on the inner side thereof any projection or pivot-pin. That edge of circumferential wall 6 removed from basket bottom 4, is provided over a substantial portion of the circumference thereof with an outer rim 8 having a notch 10 for receiving a positioning finger 42 shown in FIG. 3, which prevents the basket rotating together with the outer hook 2. The notch 10 continues in a side recess 10' in rim 8 for the passage of the upper thread 9 as shown in FIG. 1.

The basket 1 is moreover provided with a cover 11 attached by means of a hinge to the edge of wall 6. The cover 11 retains the bobbin 3 with the lower thread 9, lying loose inside the basket 1. In the closed position, the cover 11 touches the upper edge of wall 6. The hinge 12 has a fixed part attached to the edge of wall 6; said part 46 is provided on the side thereof facing the basket inner side, with a conical recess 13. The cover 11 is provided in turn with a fork 47 lying on either side of the fixed hinge part 46. The fork 47 and the hinged part 46 are joined by a pin 48. In the cover, facing recess 13 is provided a cylindrical recess 14 inside which is received a spring 15 which pushes a bolt 16 outwards against the fixed part 46 of hinge 12. When the cover 11 is swung to the closed position, the bolt 16 lies out-of-center in recess 13; during the opening of cover 11, the bolt 16 is pushed away from opening 13 by compressing spring 15; said arrangement comprises a locking of cover 11 in the closed position.

Figure 5:
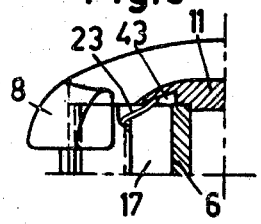
FIG. 5 is a section along line V—V in FIG. 1, with the cover closed and the bobbin not shown.

The basket 1 is provided with a spring brake 17 for the lower thread 9. Said brake is comprised of a small spring plate 17 which is attached to wall 6 by means of a screw 18. The pressure of spring 17 can be adjusted by means of a set screw 18'. When the rotary hook is mounted in a sewing machine, the notch 10 in rim 8 is located on the hook upper side; under such conditions, the small brake plate 17 extends from the hook bottom along that direction opposite the hook rotating direction when looking at the hook from the side of cover 11 of basket 1. On that portion of the circumference thereof that begins along the spring rotating direction, somewhat in front of the end 19 of the small brake plate 17 and up to adjacent that end of the small brake plate 17 attached by the screws 18,18', the basket wall 6 is double in that partion thereof adjacent that edge removed from basket bottom 4; in 49 has been shown the separation between both partitions 6', 6'' thus formed; the rim 8 follows the outer partition 6''. The small spring plate 17 extends from the outer side of circumferential wall 6 in the space 49 between partitions 6', 6'' and bears resiliently against the outer partition 6''. That end of spring 17 located in space 49 forms a point 19 which is slightly curved outwards and lies level with a opening 20 provided in wall 6 on the inner side of rim 8. The small spring plate has a groove 21 which extends from that edge removed from basket bottom 4 towards said bottom and point 19 thereof. To said groove 21 in spring 17 corresponds a somewhat larger groove 22 in wall 6. The lower thread 9 extends from the bobbin 3 through the grooves 21 and 22 and then between that spring surface facing the outer partition 6'' and said partition towards the hook outer side by going through notch 10' of wall 10 after following a path determined by the point 19 of spring plate 17. By the location of groove 21, the spring 17 has a sharp corner 23 which is directed on the one hand towards the inner side of basket 1 and on the other hand, away from bottom 4. Said corner has for purpose to guide the thread when threading the machine and to catch the lower thread and retain same inside the basket when said thread has some slack. A recess 43 shown in FIG. 5 and in phantom in FIG. 1, is provided in cover 11 to receive said sharp corner 23 and allow the lower thread 9 to pass through.

The basket 1 contains a bobbin 3 with a hollow axis 24 and two flanges 25. As it is clear from FIG. 3, the transition between the hollow axis and the flanges 25 is radiused to prevent the lower thread wound about the hollow axis 24, catching by the junction of axis 24 with flanges 25. To each flange 25 is further attached a small rod 26 which extends across the opening and which serves as gripping member for the bobbin.

Figure 2:
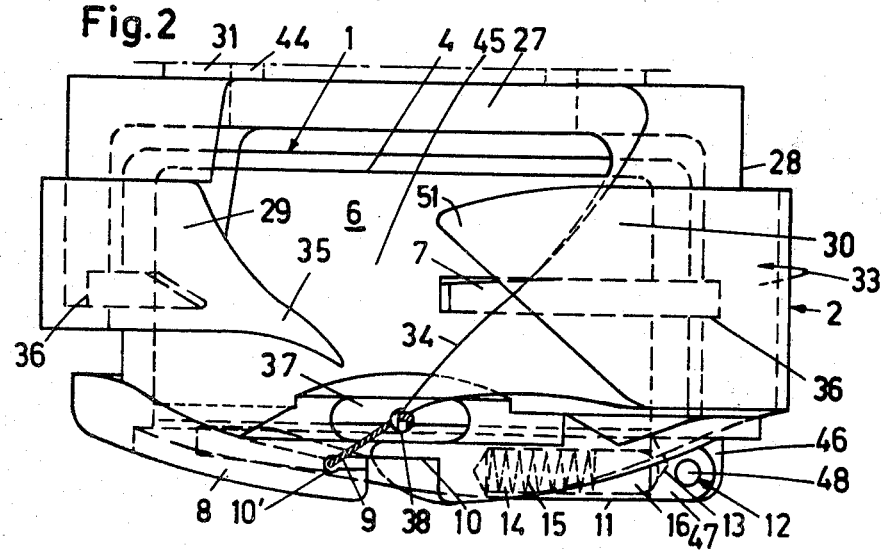
FIG. 2 is a section along line II—II in FIG. 1, the basket cover being shown closed.

The outer hook has a bottom 27 and a circumferential wall 28 which surrounds wall 6 of basket 1; the outer hook 2 further comprises a clamping ring 29 which is made fast by means of screws to the outer side of circumferential wall 28 so as to enclose basket 1 in the outer hook. Finally, the outer hook 2 has on that side opposite the clamping ring 29, a curved body-guard 30 which is also attached by means of screws to the outer side of circumferential wall 28. The bottom 27 of hook 2 that lies at right angle to the rotating axis, is provided with a sleeve 31 for making hook 2 fast to a driving shaft. Inside said sleeve 31 is made fast by means of a screw 32, a replaceable auxiliary sleeve 44 the inner diameter of which fits the diameter of the sewing machine driving shaft. The wall 28 of hook 2 is locally broken by a location that merges in the position shown in FIG. 2, with the break 45 in the rib 7 of basket 1. By the break location, the front end of wall 28 along the outer hook rotating direction shown by arrow 33, forms a sharp beak 34 located in extension of that edge of wall 28 removed from bottom 27. The inner side of wall 28 forms to the exception of the location of beak 34, a cylindrical cover which is concentric with the rotating axis.

The beak 34 projects outwards relative to the diameter of circumferential wall 28. As shown in the drawings, the beak 34 runs away relative to the rotating axis of hook 2, approximately tangentially to the circumferential wall 28. The inner side of the end of beak 34 lies at a distance *a* of about 2.5 mm relative to the trace of wall 28 by the break in said wall. The body-guard 30 ends towards beak 34, in a point-shaped end 51 that lies nearer bottom 27 of hook 2 than beak 34. The sharp beak 34 of outer hook 2 projects outside body-guard 30. The outer side of beak is stepped inwards relative to the outer side of wall 28 of outer hook 2, in that area 51 where the beak 34 connects to wall 28; in 52 has been shown the small slanting surface joining beak 34 to circumferential wall 28.

The clamping ring 29 or gip ends on that side facing beak 34 in a point 35 located in the break in wall 28. Adjacent the clamping ring, the wall 28 has a height which is lower than the height of wall 28 by the location of body-guard 30. Level with the free edge thereof located underneath the clamping ring, the circumferential wall 28 has a groove 36 which also extends over that portion of wall 28 to which is attached the body-guard 30; said groove 36 slidingly receives rib 7 of basket 1.

Figure 3:
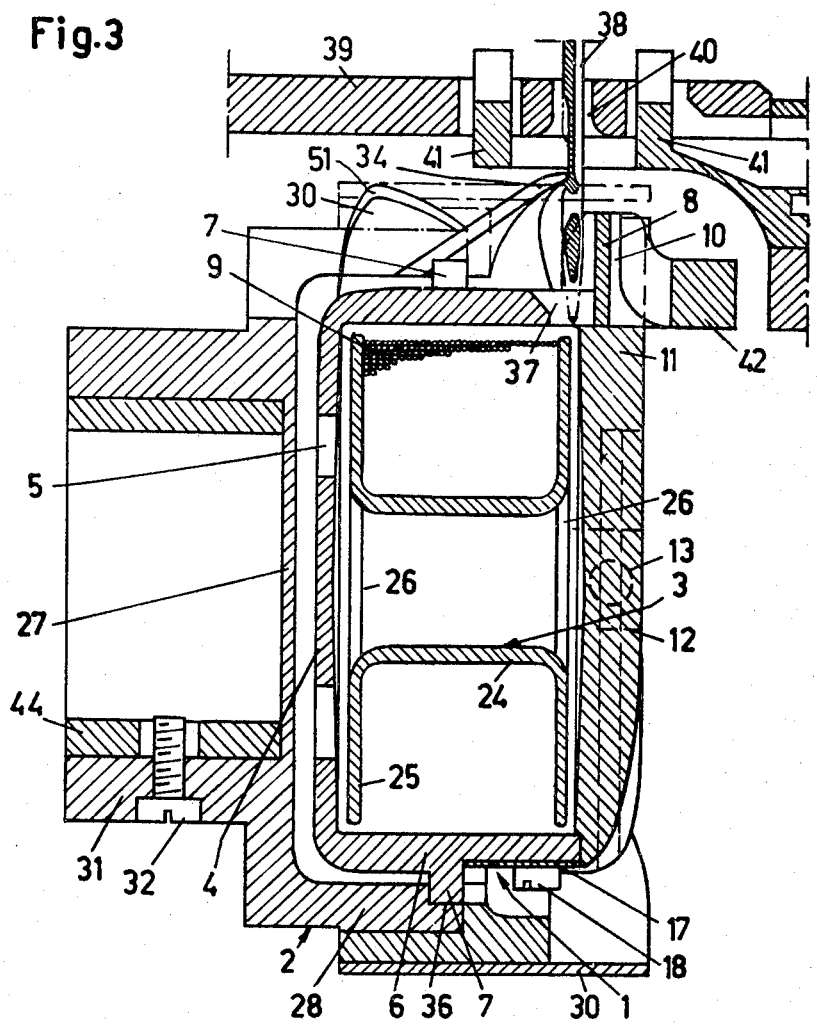
FIG. 3 is a section along line III—III in FIG. 1, with the cover also closed.
Figure 4:
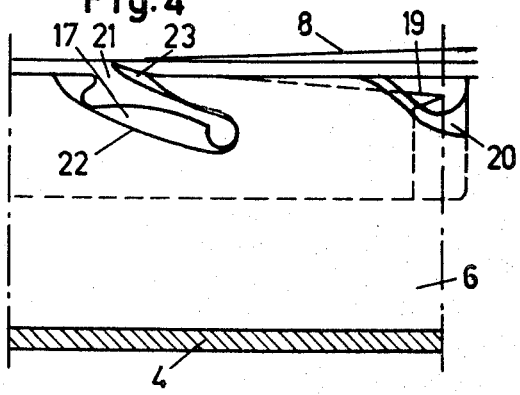
FIG. 4 is a section along line IV—IV in FIG. 1 with the cover closed but with the bobbin not shown.

Finally, wall 6 of basket 1 has an opening 37 for needle 38 which lies directly behind rim 8 by the location of notch 10. The rotary hook 53 is arranged below the needle-plate 39 of the sewing machine. The positioning finger 42 prevents basket 1 rotating and retains same in such a position that opening 37 in the circumferential wall 6 of basket 1 lies below the needle hole 40 in needle-plate 39. In FIGS. 1 and 3 have only been shown besides the rotary hook 53, the needle 38, the needle-plate 39 and the feed dogs 41 for the material to be stitched. The needle 38 has been shown in solid lines in the drawings in that position where the upper thread loop is formed, and in phantom in the lowermost position thereof. As shown in FIG. 3, in said lowermost position, the needle point lies outside the inner volume of basket 1.

To form a stich, the threaded needle 38 goes down, passes through the material to be stitched and the needle hole 40 and enters the openings 37 in the circumferential wall 6 of basket 1. The rotating movement of the outer hook 2 is so synchronized with the alternating vertical movement that when said needle goes through the material to be stitched and the needle hole 40, the break in the circumferential wall 28 of outer hook 2 lies underneath the needle, in such a way that said needle comes to lie between the beak 34 and the point 51 of the body-guard 30 on the one hand and the point 35 of the clamping ring 29 on the other hand, to enter the opening 37 of basket 1. As soon as the needle has reached the lowermost position thereof, it goes upwards over a small distance of about 2 mm, whereby a loop is formed in the upper thread. The beak 34 of outer hook 2 then enters said loop and takes same along over the basket 1. The remaining movement of outer hook 2 and the other parts of the sewing machine are as usual. As the beak end lies farther away from the rotating axis of hook 2 than the wall 28 of said hook 2, the upper thread loop does not have to come as low as in the known rotary hooks in which the beak end lies approximately in the extension of the circumferential wall of the outer hook. There results the series of advantages mentioned above; a further advantage lies in the needle 38 lying in the lowermost position thereof higher than with the known rotary hooks, a smaller portion of the length thereof goes through the material to be stiched and a larger portion remains freely in the air; there results therefrom a smaller friction of the needle in the sewing machine and a better cooling of said needle which reduces the danger of the thread breaking due to the needle heating and allows to raise the sewing machine speed.

It should also be noted that in FIG. 1 has been shown in phantom that position of the beak 34 of outer hook 2 which corresponds to the lowermost position of needle 38.

In another embodiment of the invention, the bobbin 3 is a throw-away bobbin of paper or plastics and the lower thread 9 wound on the bobbin is slightly glued-in whereby the tendency of the lower thread windings to come loose when the pulling thereon stops suddenly but the bobbin 3 still rotates somewhat due to the inertia, is reduced. In another variation, the rotary hook does not comprise any bobbin but the lower thread forms a small cop wound on itself which can thus be arranged as such in basket 1. In such a case, it is also advantageous to slightly glue-in the thread.

In another variation, the basket 1 has no cover; the lower thread supply is retained inside the basket 1 either by a compressed air stream directed inside the basket, or by a magnetic ring which is retained by magnetic attraction against the metal basket 1.

It must be understood that the invention is in no way limited to the above embodiments and that many changes may be brought therein without departing from the scope of the invention as defined by the appended claims.

I claim:

1. A rotary hook assembly for a sewing machine of the type having a needle which reciprocates between an upper position and a lower position and which is provided with an eye for an upper stitch-forming thread and a rotary hook rotatable about a horizontal axis having a non-rotating basket therein for the reception of a stitch-forming lower thread about which said rotary hook rotates, said hook having a bottom wall extending perpendicular to said horizontal axis which passes through the center of said bottom wall and a circumferential wall extending axially to a front edge, a break in said circumferential wall extending from said front edge in the direction of said bottom wall and defining a beak portion adapted to capture a loop of the upper thread formed at the level of the needle eye when the needle moves upwardly from its lower position to its upper position, said beak portion projecting outwardly relative to the outer hook circumferential wall, said outer hook being further provided with a body-guard attached to the circumferential wall, the improvement residing in that said beak projects substantially tangentially outwardly relative to the outer hook circumferential wall to an extent which enables it to capture the needle loop of the needle which in its lowest position is outside the interior of the inner basket and said body-guard is provided with a point-shaped end adjacent to and disposed radially inwardly of said beak.

2. A rotary hook assembly as set forth in claim 1, wherein the outwardly projecting distance of the beak end inner surface from the circumferential wall inner surface is about 2.5 mm measured along a radius of said circumferential wall.

3. A rotary hook assembly as set forth in claim 1, wherein a brake is mounted on the basket circumferential wall, said brake being a spring plate that bears partly at least against the outer side of an inwardly-recessed portion of the basket circumferential wall, said spring plate being provided with an opening for the lower thread that opens on the basket inner side in such a way that said lower thread can be pulled through said opening between the spring outer side and the inner side of said portion of the basket circumferential wall.

4. A rotary hook assembly as set forth in claim 3, wherein the spring plate is made fast by means of at least one screw to the basket wall outer side and said plate is provided at the other end thereof with a point that runs slightly away from the rotating axis adjacent the free edge of the basket circumferential wall.

5. A rotary hook assembly as set forth in claim 3, wherein the opening in the spring plate forms a groove slanting towards the basket bottom and the sharp angle portion formed between said groove and that edge removed from the basket bottom, of the spring plate which is slightly bent inwards relative to the basket and away from the bottom, and enters a groove provided in the basket circumferential wall by the location of the groove provided in the spring plate.

6. A rotary hook as claimed in claim 1 wherein said basket has no pivot for a bobbin, cover means being mounted on said basket for retaining the lower thread supply and locking means being provided to maintain the cover in closed position on said basket.

7. A rotary hook assembly as set forth in claim 1 wherein said cover being hinged on the basket by means of a hinge comprising a hinge part projecting from the basket circumferential wall edge, said hinge fixed part being provided on that side facing the cover in the closed position thereof, with a recess and the second hinge part supported by the cover comprises a spring received inside a cover recess and a bolt pushed under the action of said spring against the hinge fixed part, said bolt being forced in the cover closed position, inside the fixed hinge part recess.

* * * * *